US006719567B2

(12) United States Patent
Billman et al.

(10) Patent No.: US 6,719,567 B2
(45) Date of Patent: Apr. 13, 2004

(54) CONTACT FOR ELECTRICAL CONNECTOR

(75) Inventors: Timothy B. Billman, Dover, PA (US); Joanne E. Shipe, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/152,540

(22) Filed: May 20, 2002

(65) Prior Publication Data

US 2003/0216086 A1 Nov. 20, 2003

(51) Int. Cl.[7] ..... H01R 12/00
(52) U.S. Cl. ..... 439/65
(58) Field of Search ..... 439/862, 65, 733

(56) References Cited

U.S. PATENT DOCUMENTS 5,975,921 A * 11/1999 Shuey ..... 439/83
6,135,782 A * 10/2000 Cox et al. ..... 439/65
6,406,305 B1 * 6/2002 Wu ..... 439/65

* cited by examiner

*Primary Examiner*—Gary Paumen
(74) *Attorney, Agent, or Firm*—Wei Te Chung

(57) ABSTRACT

A contact (1) for use with an electrical connector (2) for interconnecting a daughter board (4) and a mother board (3) in a mutually perpendicular relation, comprises a body portion (10) having an upper arm (12) and a lower arm (14). The upper arm extends in a first direction which is generally parallel to an axial direction of the body portion and the daughter board. The lower arm extends in a second direction which is generally perpendicular to the upper arm. The lower arm has a free end for engaging with the mother board. The upper arm has a free end with a curved edge (222) for engaging with the daughter board. The curved edge works in a plane that is mutually perpendicular to the first and second directions, facing the first direction. The contact has a body portion from which the upper and lower arms extend. The lower arm has a curved portion (16) which connects and offsets from the body portion. The curved portion moves in the third direction, facing the first direction.

10 Claims, 2 Drawing Sheets

CONTACT FOR ELECTRICAL CONNECTOR

BACKGROUND OF THE INVENTION

1. Field of the Invention

The present invention relates to a contact for use in an electrical connector, and particularly to a contact used in an electrical connector for electrically connecting a mother board and a daughter board together, wherein the daughter board is oriented perpendicularly to the mother board.

2. Description of Related Art

Backplane/mother board is a printed circuit board on the upper side of which a plurality of daughter boards are perpendicularly mounted to the mother board for easy removal. One way of electrically connecting the daughter board to the mother board, a backplane connector is attached on the mother board, and a mating connector is attached on the daughter board, whereby both connectors consist of an electrical connector assembly. When the two connectors are joined, a plurality of first contacts directed upwardly between the backplane connector are connected to a plurality of corresponding second contacts directed downwardly between the mating connector. However, regarding to high density array of the first and second contacts, straightly mating is able to damage connection between the first and second contacts. For connecting a mother board and a daughter board in a mutually perpendicular relationship in high density, referring to U.S. Pat. No. 5,975,921, an electrical connector which has inner circuit board is applicable to a plug or receptacle, although generally applied as a receptacle to mount on a mother board. The connector has a plurality of contacts each having a solder tail or surface mount lead for soldering to the mother board, a contact retention portion and a contact portion engaging with a pad of the inner circuit board. The inner circuit board is inserted into the connector whereby the contact portions are laterally deflected to generate a reaction force large enough to ensure a reliable engagement between the contact portions and the pads of the inner circuit board. However, the pressing force of the inner circuit board on the contact portion generates a moment which can adversely affect the solder connection between the solder tails or surface mount leads of the contacts and the mother board.

To solve this problem, prior art proposed that the contacts each have an enlarged retention portion between the contact portion and the soldering tail for engaging with a housing of the connector. The enlarged retention portion unavoidably increases the size of the contact, which is unfavorable regarding the minimization trend of connectors.

Hence, there is a need to have an improved contact which can solve the problem of the prior art.

SUMMARY OF THE INVENTION

Accordingly, it is an object of the present invention to provide a contact used in an electrical connector, which is capable of improving the engagement between the electrical connector and a printed circuit board.

It is another object of the present invention to ensure each contact has reliable contact with a circuit trace of a printed circuit board to establish an efficient electrical connection.

According to one aspect of the present invention, a contact is used in an electrical connector for connecting first and second printed circuit boards in a mutually perpendicular relation. The contact comprises a body portion having a first side and a second side opposite to the first side, and an upper arm and a lower arm. The upper arm extends upwardly from the body portion. The lower arm extends downwardly from the body portion and sideways in a direction from the first side toward the second side of the body portion. The upper arm has a free end with a curved edge adapted for engaging with the first printed circuit board. The curved edge faces in a direction from the second side toward the first side of the body portion. The lower arm has a free end adapted for engaging with the second printed board and a curved portion connecting with the body portion.

According to another aspect of the present invention, the curved portion extends from the body portion. The body portion forms a plurality of serrations at the first side adapted for engaging with a housing of the electrical connector.

Other objects, advantages and novel features of the invention will become more apparent from the following detailed description when taken in conjunction with the accompanying drawings.

DETAILED DESCRIPTION OF THE INVENTION

Figure 1:
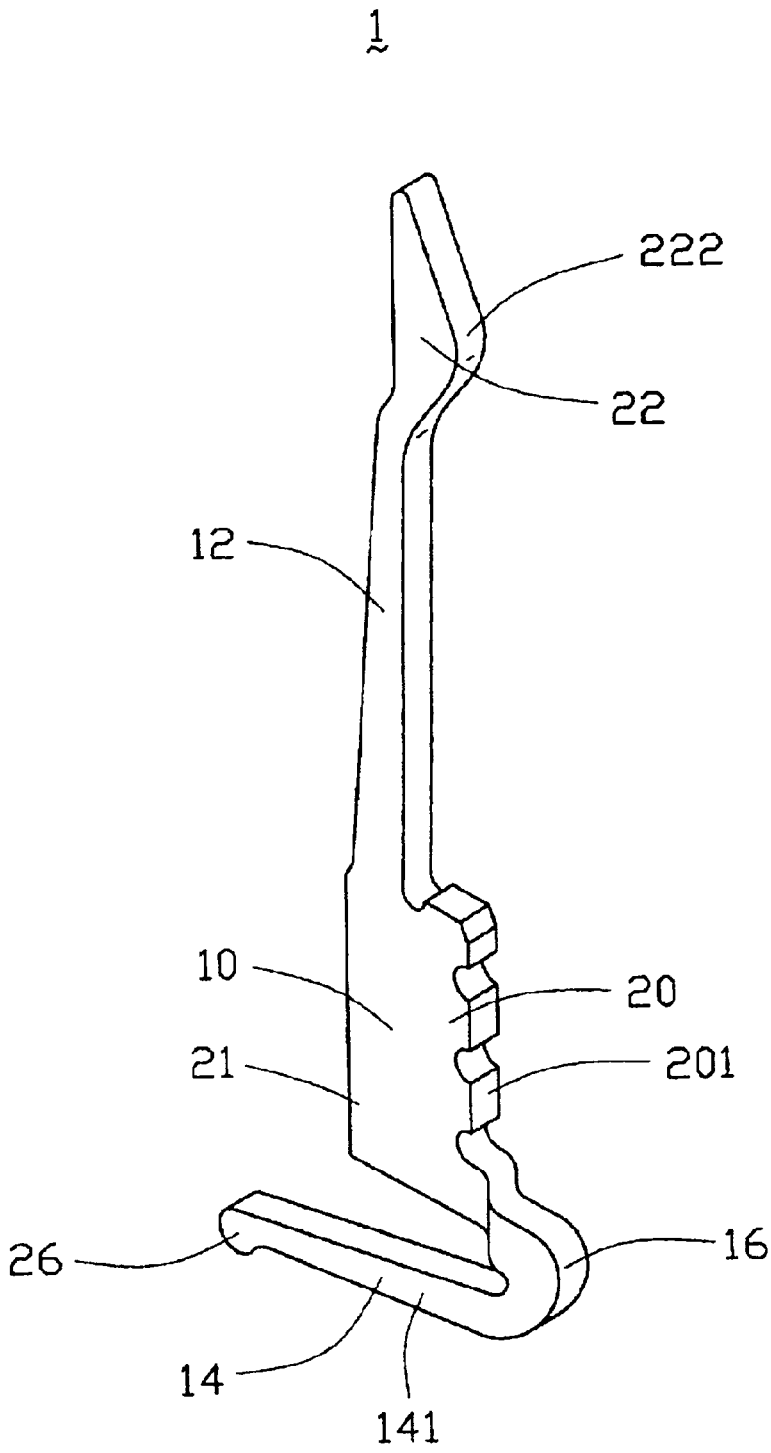
FIG. 1 is a perspective view of a contact in accordance with an embodiment of the present invention.
Figure 2:
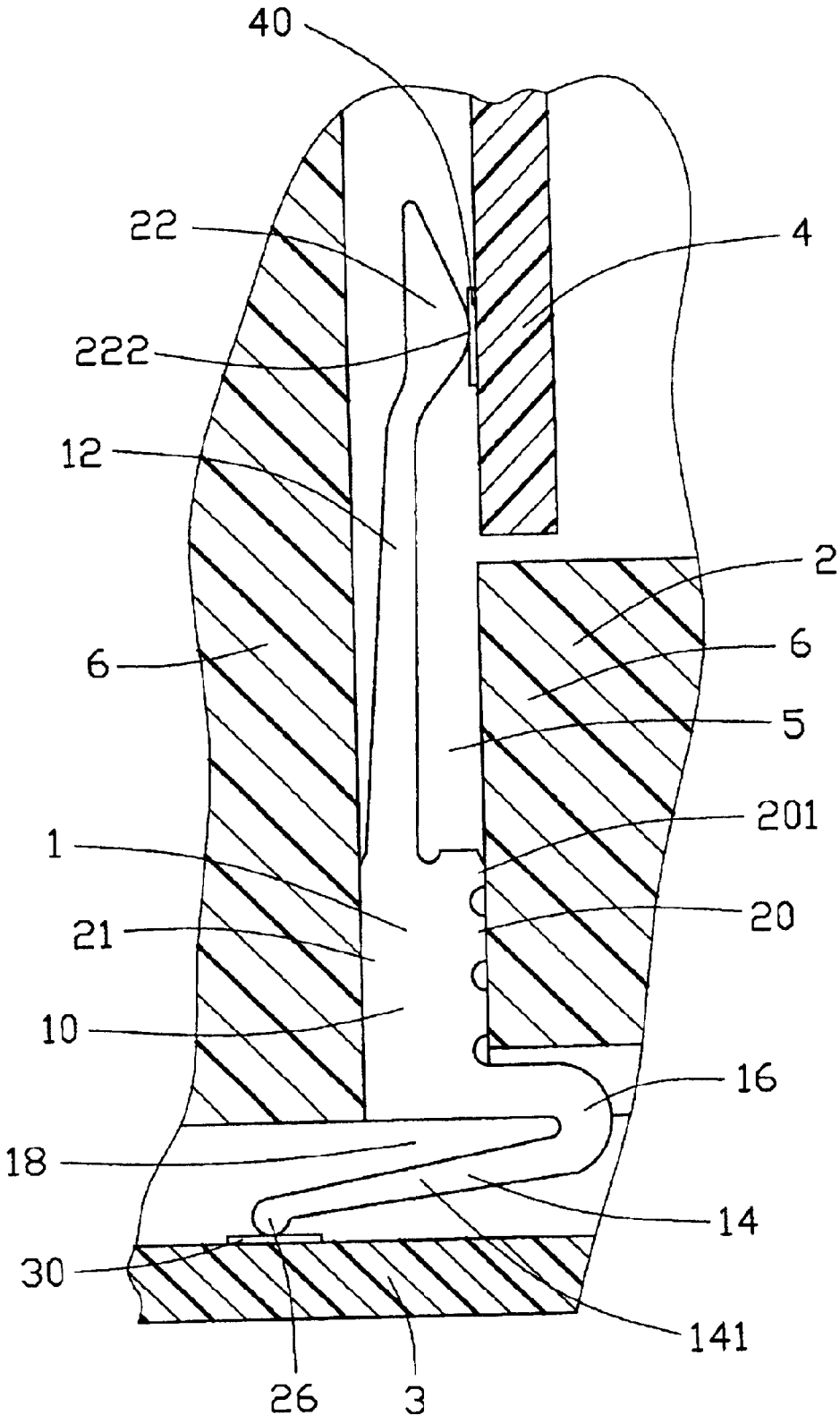
FIG. 2 is a partially cross-sectional view showing the contact of FIG. 1 which is mounted in a connector and interconnects a daughter board and a mother board.

FIGS. 1 and 2 shows a contact 1 in accordance with an embodiment of the present invention. The contact 1 is mounted in a dielectric housing 6 of an electrical connector 2, which is used for interconnecting a mother board 3 and a daughter board 4 in a mutually perpendicular relation. The housing 6 defines a cavity 5 to receive the contact 1 therein. The contact 1 has a body portion 10 disposed in the cavity 5 of the housing 6, and upper arm 12 and lower arm 14 projecting upwardly and downwardly respectively from upper and lower ends of the body portion 10. The body portion 10 has a first side 20 forming a plurality of serrations 201 having an interferential engagement with the housing 6, and a linear second side 21 opposite the first side 20 abutting against the housing 6. The lower arm 14 is generally perpendicular to the upper arm 12 for engaging with a circuit trace 30 on the mother board 3. The lower arm 14 has a horizontal curved portion 16 connecting with and offsetting from body portion 10. The curved portion 16 is attached to the first side 20. The curved portion 16 provides a spring feature to the lower arm 14. A leg 141 extends from a lower part of the curved portion 16 in a direction from the first side 20 toward the second side 21. A space 18 is defined between a bottom edge of the body portion 10 and the leg 141 so that a free end 26 of the lower arm 14 can resiliently contact with the circuit trace 30 of the mother board 3 when the electrical connector 2 is pressed onto the mother board 3, by which an upward vertical force is exerted to the free end 26 of the lower arm 14. The free end 26 is located behind the second side 21.

The upper arm 12 has a top free end 22 which has a curved edge 222 facing in a direction from the second side 21 toward the first side 20. The edge 222 is located substantially in line with the first side 20 along an axial direction of the body portion 10. The edge 222 engages with a circuit trace 40 of the daughter board 4 when the daughter board 4 is inserted into the connector 2. The daughter board 4 exerts a horizontal force to the free end 22 which causes the upper arm 12 to deflect so that a reaction force is generated at the free end 22 which causes the curved edge 222 to have a reliable engagement with the circuit trace 40. The daughter board 4 exerts a horizontal force to the free end 22 in a direction from first side 20 toward the second side 21.

In the present invention, after the assembly of the connector 2 and the mother board 3 and the daughter board 4 as shown in FIG. 2, the mother board 3 exerted a clockwise moment to the body portion 10 of contact 1 and the daughter board 4 exerts a counterclockwise moment to the body portion 10. These two moments acts on the body portion 10 in opposite directions so that they are counterbalanced with to each other. Thus, a resultant moment acting on the body portion 210 can be reduced in comparison with any one of these two moments. Accordingly, the body portion 10, which has a small size, is sufficient to secure the contact 1 in the cavity 5 of the housing 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact for an electrical connector for connecting first and second printed circuit boards in a substantially perpendicular relation, comprising:

a body portion having a first side and a second side opposite the first side;

an upper arm extending upwardly from the body portion, the upper arm having a free end with a curved edge adapted for engaging with the first printed circuit board, the curved edge facing in a direction from the second side toward the first side of the body portion; and a lower arm extending downwardly from the body portion and comprising a curved portion connecting with the body portion and facing in a direction from the second side toward the first side, and a leg extending from the curved portion along a direction from the first side toward the second side.

2. The contact as described in claim 1, wherein the lower arm having a free end adapted for engaging with the second printed circuit board.

3. The contact as described in claim 1, wherein the curved portion offsets from the body portion.

4. The contact as described in claim 1, wherein the body portion forms a plurality of serrations at the first side adapted for engaging with a housing of the electrical connector.

5. The contact as described in claim 1, further comprising a space defined between the body portion and the leg of the lower arm.

6. An electrical connector for interconnecting a first PCB and a second PCB which is substantially perpendicular to the first PCB, comprising:

a housing having a cavity which receives a contact therein;

said contact having an upper arm, a body portion, and a lower arm, said upper arm defining a free end resiliently and electrically engaging with the first PCB, said first PCB exerting a horizontal force to the free end of the upper arm, said lower arm extending generally perpendicular to the upper arm and having a free end electrically engaging the second PCB, said second PCB exerting an upward vertical force to the free end of the lower arm, a moment generated by the horizontal force to the contact being counterbalanced by a moment generated by the vertical force to the contact, the upper and the lower arms extending from the body portion, the body portion having a serration on a side thereof, the serration engaging with the housing.

7. The electrical connector as described in claim 6, wherein the lower arm has a curved portion connecting with the body portion, and the curved portion offsets from the body portion and provides a spring force for the lower arm.

8. An electrical connector assembly comprising:

a body defining a cavity therein;

a daughter board disposed in the cavity;

a mother board on which the body is seated; and a terminal received in the cavity, said terminal including a body portion with retention means retaining the terminal in the cavity, an upper arm projecting from an upper end of the body portion and extending generally in a vertical direction and engaged with the daughter board with a first reaction force thereof, a lower arm projecting from a lower end of the body portion and extending generally in a horizontal direction and engaged with the mother board with a second reaction force thereof, said body portion defining a main plane with a transverse dimension, along a width direction thereof, much larger than that defined along a thickness direction of said body portion; wherein said first reaction force and said second reaction force are configured to have two respective associated bending moments somewhat counterbalanced so as to assure reliability of retention of the terminal in the cavity, axis directions of said two bending moments are essentially perpendicular to said main plane.

9. The assembly as described in claim 8, wherein said mother board is perpendicular to said daughter board.

10. The assembly as described in claim 8, wherein said upper arm and said lower arm are uncoplanar.

* * * * *